US005611467A

United States Patent [19]

Peng

[11] Patent Number: 5,611,467

[45] Date of Patent: Mar. 18, 1997

[54] INVERTIBLE PRESSURIZED FLUID DISPENSER WITH GUIDED FLUID INLET MEMBER

[76] Inventor: Karl K. Peng, 1414 Son Center Rd., Apt. 422, Mayfield Heights, Ohio 44124

[21] Appl. No.: 643,891

[22] Filed: May 7, 1996

[51] Int. Cl.[6] ..... B65D 83/14; B67D 5/60

[52] U.S. Cl. ..... 222/464.4

[58] Field of Search ..... 222/321.4, 376, 222/382, 402.19, 464.1, 464.3, 464.4, 464.5, 464.7

[56] References Cited

U.S. PATENT DOCUMENTS

| | | | |
|---|---|---|---|
| 750,521 | 1/1904 | Braymer | 239/342 |
| 1,544,600 | 7/1925 | Sammis | 222/376 |
| 1,568,084 | 1/1926 | Pearsons | 222/376 |
| 1,710,163 | 4/1929 | Hartney et al. | 169/72 |
| 1,719,277 | 7/1929 | Parker | 169/74 |
| 1,887,013 | 11/1932 | Coffield | 169/72 |
| 2,315,263 | 3/1943 | Lindsay | 169/72 |
| 2,472,506 | 6/1949 | Zieschang | 222/402.19 X |
| 2,556,180 | 6/1951 | Hamilton et al. | 222/321.4 |
| 2,785,923 | 3/1957 | Hickman | 239/307 |
| 3,088,680 | 5/1963 | Fulton et al. | 222/464.4 X |
| 3,169,677 | 2/1965 | Focht | 222/464.1 |
| 3,490,656 | 1/1970 | Taschner | 222/464.4 X |
| 3,545,488 | 12/1970 | Venus | 222/376 X |
| 3,580,430 | 5/1971 | Angele | 222/464.4 X |
| 3,667,655 | 6/1972 | Knieriem, Jr. | 222/464.4 |
| 3,733,013 | 5/1973 | Doyle | 222/402.19 |
| 3,893,596 | 7/1975 | Beres et al. | 222/402.19 |
| 4,019,661 | 4/1977 | Szabo | 222/376 |
| 4,273,272 | 6/1981 | Blanc | 222/464.4 |
| 5,222,636 | 6/1993 | Meuresch | 222/402.19 X |
| 5,397,034 | 3/1995 | Wunsch | 222/464.3 X |

FOREIGN PATENT DOCUMENTS

| | | | |
|---|---|---|---|
| 2700483 | 7/1994 | France | 222/464.4 |
| 2706872 | 12/1994 | France | 222/464.4 |
| 4107301 | 9/1992 | Germany | 222/464.4 |
| 677197 | 4/1991 | Switzerland | 222/464.4 |

*Primary Examiner*—Kevin P. Shaver

*Attorney, Agent, or Firm*—Dann, Dorfman, Herrell and Skillman, P.C.

[57] ABSTRACT

A pressurized fluid dispenser is provided with a shuttle member having a fluid inlet for withdrawing fluid from within the dispenser. A rigid guiding member is provided for guiding the shuttle member axially when the container is moved between respective upright and inverted orientations. One end of a helical flexible tube is connected in fluid communication with an internal fluid passageway formed in the shuttle member. The other end of the flexible tube is connected in fluid communication with a conduit formed in the guiding member. The conduit is connected with an externally-actuatable valve. Translation of the shuttle member upon the guiding member allows the dispenser to be operated in the respective upright and inverted orientations.

27 Claims, 3 Drawing Sheets

INVERTIBLE PRESSURIZED FLUID DISPENSER WITH GUIDED FLUID INLET MEMBER

FIELD OF THE INVENTION

The present invention relates to pressurized fluid dispensers. In particular, the present invention relates to an invertible pressurized fluid dispenser having a translatable fluid inlet member for transferring fluid out of the dispenser, wherein the fluid inlet member is guided along a rigid guide member to prevent obstruction of a flexible fluid transfer tube.

BACKGROUND OF THE INVENTION

Pressurized fluid dispensers, such as aerosol spray cans, are known wherein a container is filled with a fluid, or mixture of fluids, and with a quantity of pressurized propellant gas. Typically, a rigid or semi-rigid dip tube is positioned within the container to receive fluid from the bottom of the container and to transfer the fluid to an externally-actuatable valve assembly in response to actuation of the valve. In the use of such dispensers, it is necessary to hold the container in an upright orientation in order to maintain the collection end of the dip tube positioned within the fluid to be dispensed. When the dispenser is inverted, the supply of fluid moves to the valve end of the can, and the inlet end of the dip tube then extends into the volume occupied by the propellant gas. Actuation of the valve then results in loss of propellant without dispensing the desired fluid. It would be desirable to provide a pressurized fluid dispenser that is configured to dispense a desired fluid in both an upright and inverted orientation.

Known devices for providing an invertible pressurized fluid dispenser include a gravity-actuated valve mechanism for selectively withdrawing fluid from two alternative fluid collection inlets positioned within the container. Such a selective valve mechanism can be incorporated into a dip tube assembly, as exemplified in U.S. Pat. No. 2,315,263 or in U.S. Pat. No. 3,545,488. Alternatively, such a mechanism can be constructed as part of the dispensing valve as exemplified in U.S. Pat. No. 5,222,636. Such a gravity-actuated valve mechanism requires precision-machined internal moving parts and seating surfaces in order to provide a gas-tight seal against the pressure exerted by the propellant gas through the inlet opening which is to be sealed in either orientation of the dispenser. Such a gas-tight seal would be difficult to obtain in dispensers employed for dispensing fluids of various viscosities or fluids containing suspended particulate materials.

Another approach to providing an invertible pressurized fluid dispenser employs a flexible dip tube having a weighted inlet end which is freely suspended within the container in order to move with the contained fluid under the influence of gravity. Such assemblies are exemplified in U.S. Pat. Nos. 3,088,680, 3,490,656 and 3,580,430. Such devices are limited in application to containers that are suitably short to avoid kinking, twisting, knotting, or other random deformation of the flexible dip tube which may obstruct or reduce fluid flow. It would be desirable to provide an internal fluid collection apparatus wherein an inlet end of the apparatus may be translated to the fluid-containing part of the container, and in which the fluid transmission means maintains a predetermined configuration to avoid random deformation.

SUMMARY OF THE INVENTION

In accordance with of the present invention, a pressurized fluid dispenser is provided with an internal fluid transmission conduit in the form of a flexible helical tube. One end of the tube is connected with a shuttle member having a fluid inlet formed therein and adapted to move axially within the dispenser along a predetermined path established by a guiding member when the dispenser is moved between respective upright and inverted orientations. The flexible helical tube is alternately expanded and compressed by the shuttle member to assume respective predetermined configurations in the upright and inverted orientations of the dispenser.

BRIEF DESCRIPTION OF THE DRAWINGS

The foregoing summary as well as the following detailed description of the preferred embodiments of the present invention will be better understood when read in conjunction with the appended drawings, in which.

DETAILED DESCRIPTION OF THE PREFERRED EMBODIMENTS

Figure 1:
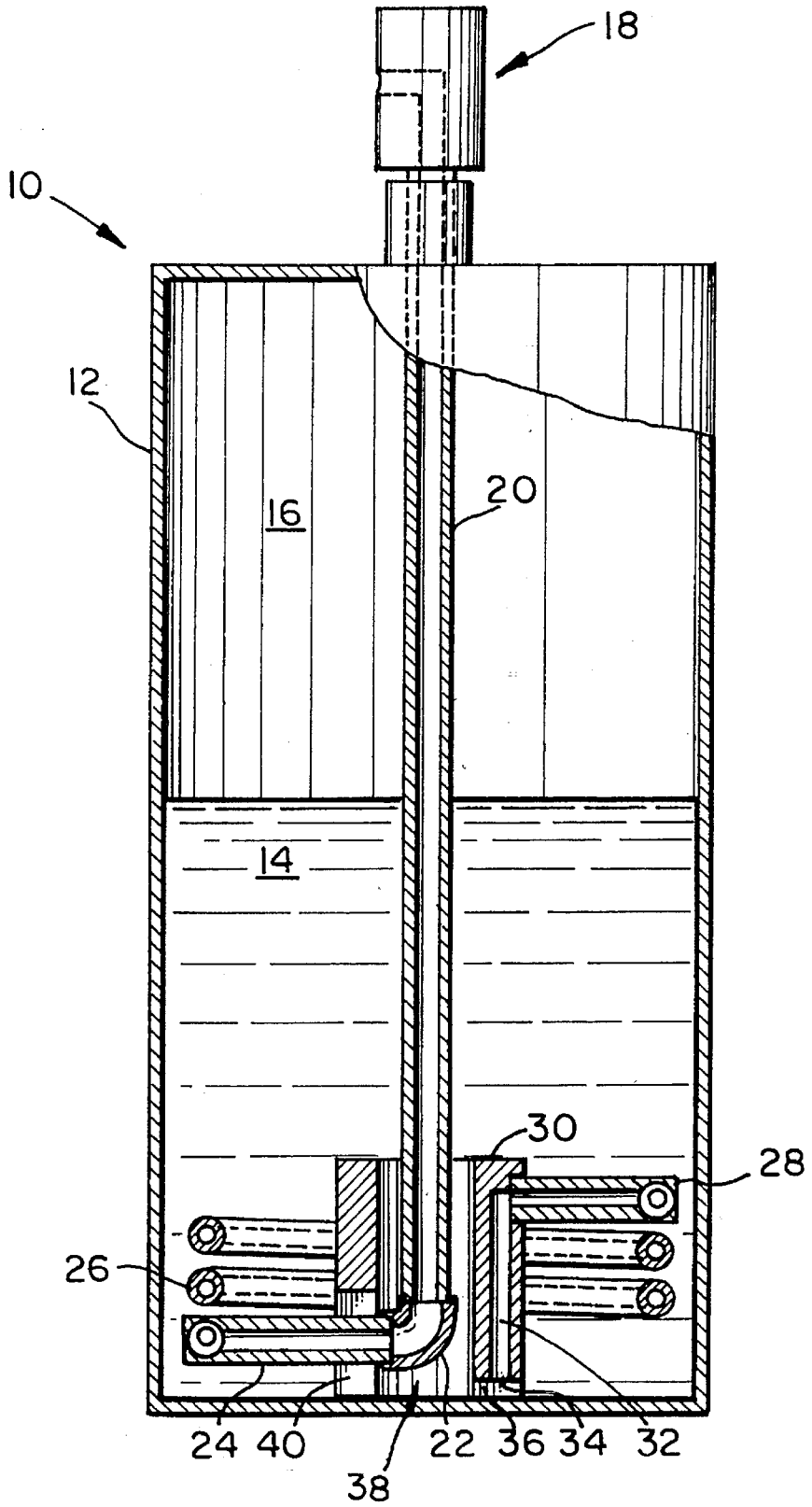
FIG. 1 is a cutaway view of a pressurized fluid dispenser of the invention positioned in an upright orientation.

Referring now to FIG. 1, there is shown a pressurized fluid dispenser 10. Although the invention shall herein be described in connection with a pressurized aerosol dispenser, it is to be understood that the invention may be practiced in connection with other fluid dispensing apparatus wherein a pressurized, or pressurizable, propellant gas is employed to eject the contents of the dispenser, such as in pump or trigger actuated fluid dispensing bottles.

The dispenser 10 comprises a container, such as a cylindrical metallic container 12, in which there is disposed a quantity of fluid 14 and a volume of pressurized propellant gas 16. A valve assembly 18 of well-known type is mounted at one end of the container. From the vantage point of a user of the dispenser 10, the external appearance and operation of the dispenser 10 is similar to that of a common pressurize aerosol dispenser, at least in the upright configuration shown in FIG. 1.

A rigid hollow rod 20 is connected within the container 12 in fluid communication with the valve assembly 18. The tube 20 extends axially within the container from proximal end of the rod, which is connected with the valve assembly 18, to the distal end of the rod, which is located near the bottom of the container 12. An elbow member 22 is connected with the distal end of the rod 20. The elbow member 22 joins the rod 20 in fluid communication with a tubular member 24 that extends radially outwardly along the bottom of the container 12 to a position adjacent the interior wall of the container 12. In an alternative embodiment, the tube 20, elbow 22 and tube 24, are formed as a unitary structure by, for example, bending an appropriately-sized length of rigid tubing material to provide an equivalent stationary L-shaped conduit having an axially extending portion from the connection with the valve 18, and a radially extending portion along the bottom of the container.

The radially-positioned end of the tubular member 24 is connected in fluid communication with one end of a length of flexible tubing 26. The flexible tubing 26 is formed to have a predetermined relaxed configuration, such as a helical configuration. The other end of flexible tubing 26 is connected in fluid communication with a radially-oriented tubular member 28. A shuttle member 30 supports the tubular member 28 in a radial orientation elevated above the bottom of the container 12 such that the coils of the flexible tubing are relaxed, or slightly compressed, between the respective connections with tubular member 24 and tubular member 28. The coils are maintained at the bottom of the dispenser by the weight of the shuttle member 30, when the dispenser is held in an upright position. An internal fluid passageway 32 is formed within the shuttle member 30. The passageway 32 is joined in fluid communication with the tubular member 28. The passageway 32 extends within the shuttle member 30 to form a fluid inlet 34 in a surface of the shuttle member 30. In the embodiment of FIG. 1, where the fluid inlet 34 is formed on a bottom surface of the shuttle member 30, a crenelation or standoff 36 is formed in the shuttle member 30 about the inlet 34 in order to maintain the inlet at a slightly elevated position from the bottom of the container. Alternatively, the passageway 32 may extend within the shuttle member to form an inlet along a lateral surface of the shuttle member 30.

Figure 3A:
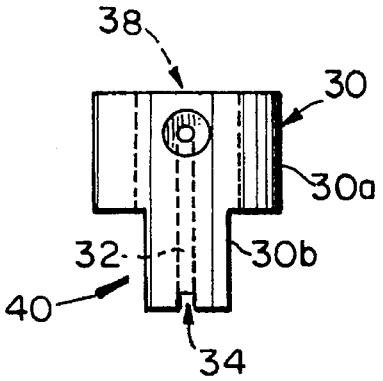
FIG. 3A is a side elevational view of a shuttle member of the pressurized fluid dispenser of FIG. 1.
Figure 3B:
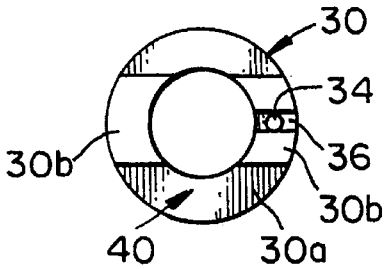
FIG. 3B is a bottom plan view of the shuttle member of FIG. 3A.

The shuttle member 30 is preferably cylindrical, but may be formed in a variety of shapes providing an axial bore 38 for positioning the shuttle member on or about the tube 20 when the container 12 is moved between respective upright and inverted orientations. As shown in FIGS. 3A and 3B, the shuttle member 30 comprises an upper cylindrical portion 30*a* having a bore 38 therein for slidable mounting upon the axial rod of the dispenser. The upper cylindrical portion 30*a* is joined to a pair of legs 30*b* for supporting the upper portion 30*a* above the bottom of the dispenser and forming an opening or standoff 40 along the lower surface of the shuttle member 30 to accommodate the radial extension of tubular member 24 toward the side of the container 12. The standoff 36 for maintaining the inlet 34 separated from the bottom of the dispenser may be provided by a groove formed along the bottom of one of the legs 30*b* and intersecting with the passageway 32.

When the valve 18 is operated with the container in the upright orientation shown in FIG. 1, fluid 14 is driven into the inlet 34 under the influence of the pressurized propellant gas 16. From the inlet 34, the fluid proceeds through passageway 32 and tubular member 28 into the helical tubing 26. The fluid 14 is further propelled through tubing 26 into tubular member 24 and then through elbow 22 into rod 20 toward the valve 18 and out of the dispenser 10.

When the container is inverted, the shuttle member 30 is axially translated within the container and guided along rod 20 toward the valve end of the container. As the shuttle member rides along the rod 20, the helical tubing 26 expands between its attachment point with tubular member 28 and its attachment point with tubular member 24 which remains stationary at the bottom of the container 12. Expansion of the tubing 26 imparts a rotary motion to the arm 28 which, in combination with the axial motion of the shuttle member 30, may desirably promote agitation or mixing of components of the fluid 14. Fins or other radial projections (not shown) may be provided on the shuttle member to further promote agitation or mixing of the fluid. Alternatively, the radial orientation of the extension arm 28 may be maintained as the shuttle is translated by, for example, providing a mating recess and projection on the respective exterior surface of the rod and the interior surface of the shuttle member 30.

Figure 2:
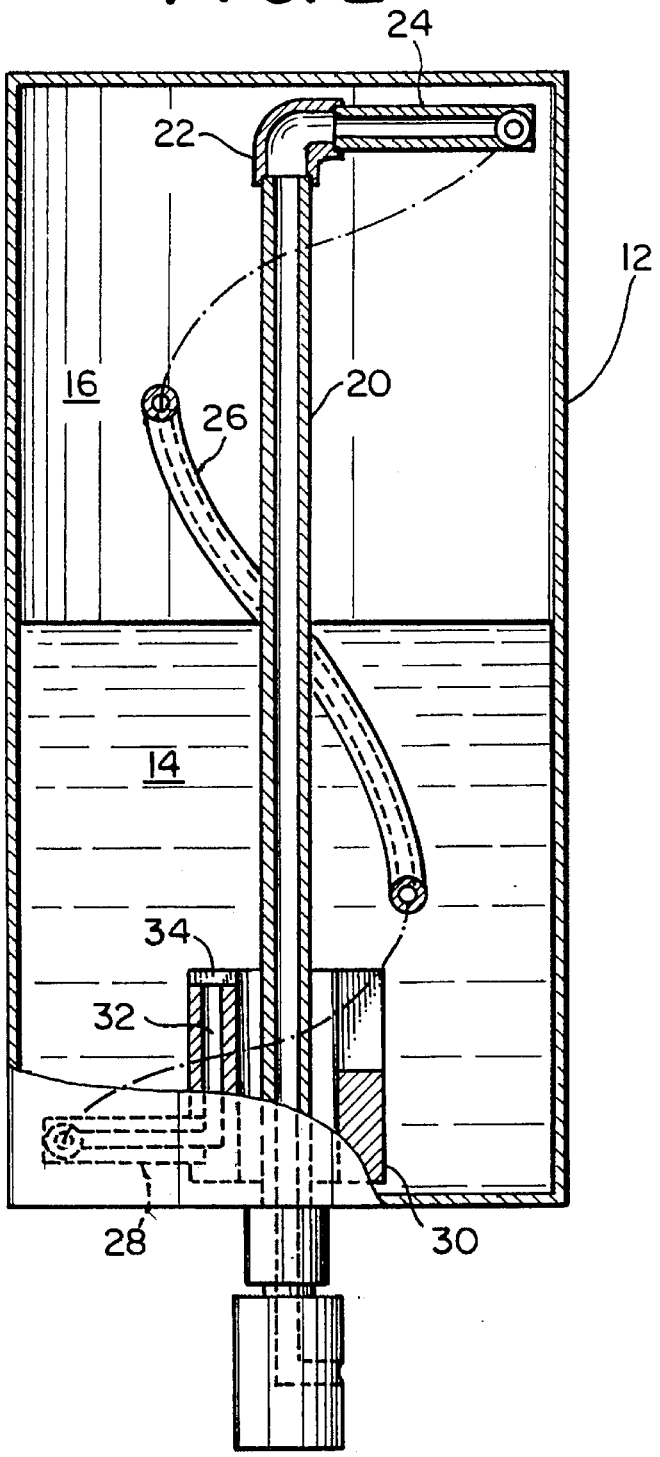
FIG. 2 is a cutaway view of a pressurized fluid dispenser of FIG. 1 positioned in an inverted orientation.

When the container is inverted, the components of the dispenser assume the configuration shown in FIG. 2. The upper surface of the shuttle member now rests against the interior of the valve end of the dispenser. The tubing 26 is expanded to extend from the tubular member 28, now also positioned near the valve end of the container 12, to the tubular member 24 which remains at the other end of the container 12. In the configuration shown in FIG. 2, fluid is dispensed by actuation of the valve 18, so that the pressurized propellant 16 drives the fluid 14 into the inlet 34, which is now situated near the valve end of the container.

Figure 4:
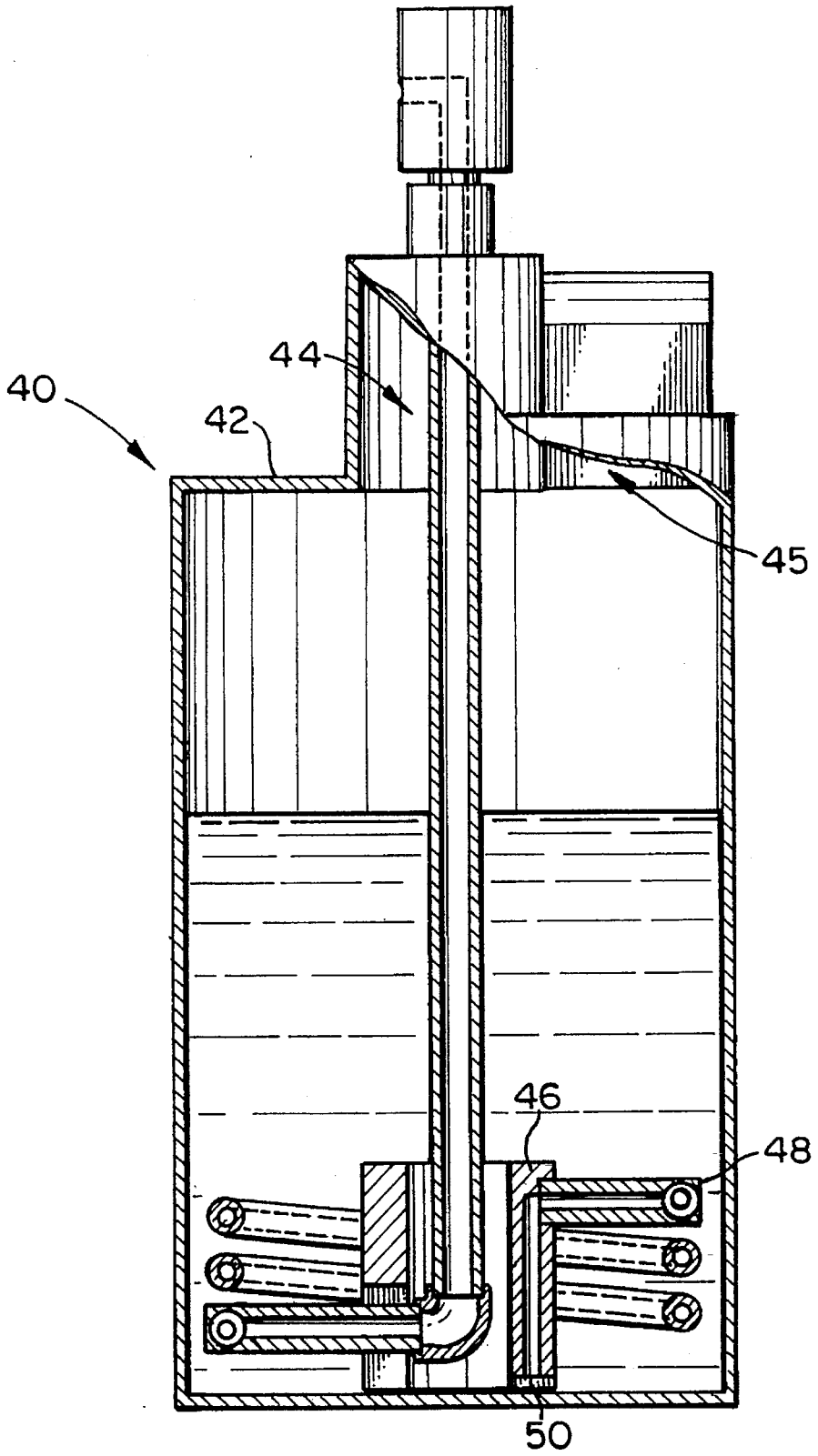
FIG. 4 is a cutaway view of an alternative embodiment of the invention.

In order to provide for more complete dispensing of fluid from the container in the inverted orientation, the valve end of the container 12 may be contoured to receive the shuttle member as shown in FIG. 4. The dispenser 40 has a top surface 42 that is configured to provide recesses 44 an 45 for receiving shuttle member 46 and tubular member 48 therein when the dispenser 40 is inverted. The reception of shuttle member 46 into the recess 44 serves to position the fluid inlet 50 substantially at the bottom of the volume of the dispenser occupied by fluid in the inverted orientation.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention as claimed.

What is claimed is:

1. An apparatus for withdrawing fluid from a container having an externally-actuatable fluid dispensing valve, the apparatus comprising:

a rigid hollow rod positioned axially within the container and having one end connected in fluid communication with the valve;

a shuttle member configured to be axially guided by the rod along a predetermined path within the container under the influence of gravity, the shuttle member having a fluid inlet and an internal fluid passageway formed therein; and a flexible tubular member connected in fluid communication between the internal fluid passageway of the shuttle member and the interior of the rod.

2. The apparatus of claim 1 wherein the shuttle member comprises a central bore formed therein for positioning the shuttle member to be guided upon the rod.

3. The apparatus of claim 1 wherein the flexible tubular member comprises a length of helical tubing.

4. The apparatus of claim 3 comprising a radially extending conduit connected with the shuttle member in fluid communication between the internal fluid passageway of the shuttle member and one end of the flexible tubular member.

5. The apparatus of claim 4 comprising a radially extending conduit connected in fluid communication between the end of the rod and the other end of the flexible tubular member.

6. The apparatus of claim 5 wherein the shuttle member comprises a central bore formed therein for positioning the shuttle member to be guided upon the rod.

7. The apparatus of claim 2 wherein the fluid inlet is formed on a bottom surface of the shuttle member and wherein the shuttle member comprises a standoff formed therein for maintaining the fluid inlet above the bottom of the container.

8. The apparatus of claim 2 wherein the flexible tubular member comprises a length of helical tubing.

9. The apparatus of claim 8 comprising a radially extending conduit connected with the shuttle member in fluid communication between the internal fluid passageway of the shuttle member and one end of the flexible tubular member.

10. The apparatus of claim 9 comprising a radially extending conduit connected in fluid communication between the end of the rod and the other end of the flexible tubular member.

11. A fluid dispensing apparatus, comprising:

a container for holding a volume of fluid;

a valve connected with one end of the container;

a rigid rod positioned within the container and having a conduit therein connected in fluid communication with the valve;

a shuttle member translatably mounted on the rod, the shuttle member having a fluid inlet formed therein; and fluid transmission means for transmitting fluid from the inlet to the conduit in the rod.

12. The apparatus of claim 11 wherein the fluid transmission means comprises:

said shuttle member having a fluid passageway formed therein for receiving fluid from said inlet; and an expandable tubular member having one end connected in fluid communication with the fluid passageway.

13. The apparatus of claim 11 wherein the fluid transmission means comprises:

a first radial tubular member positioned within the container and extending radially along the end of the container opposite said one end, the first radial tubular member connected in fluid communication between the expandable tubular member and the rod.

14. The apparatus of claim 13 wherein the fluid transmission means comprises:

a second radial tubular member connected with the shuttle member and with said one end of the expandable tubular member;

said shuttle member being adapted to compress the expandable tubular member when the container is held in a first orientation, and to expand the expandable tubular member when the container is held in a second orientation.

15. The apparatus of claim 14 wherein the expandable tubular member is adapted to impart a rotational motion to the shuttle member as said container is moved between the first orientation and the second orientation.

16. The apparatus of claim 15 wherein the expandable tubular member comprises a length of flexible tubing.

17. The apparatus of claim 16 wherein said flexible tubing is formed in a helix.

18. The apparatus of claim 11 comprising a quantity of pressurized gas within the container for propelling the fluid through the fluid transmission means.

19. The apparatus of claim 11 comprising a quantity of pressurizable gas within the container, said valve comprising means for pressurizing the pressurizable gas.

20. The apparatus of claim 11 wherein said one end of the container is contoured to receive the shuttle member therein when the container is held in an inverted position such that the fluid inlet is positioned substantially beneath the volume of fluid.

21. An apparatus for withdrawing fluid from a container having an externally-actuatable valve, the apparatus comprising:

a first rigid conduit connected in fluid communication with the valve at one end of the container, the first conduit having a first portion extending axially within the container from said one end of the container, and a second portion extending radially toward a side of the container;

a shuttle member translatably mounted on the first portion of the first conduit, the shuttle member having formed therein:

a bore for receiving the first portion of the first conduit, a lateral opening formed along a lower peripheral surface for allowing the second portion of the first conduit to extend therethrough, and an internal fluid passageway opening to a fluid inlet formed on an exterior surface of the shuttle member;

a second rigid conduit connected in fluid communication with the internal fluid passageway in the shuttle member and extending radially outward from the shuttle member; and a flexible tubing member connected in fluid communication between the second rigid conduit and the second portion of the first conduit.

22. The apparatus of claim 18 wherein the flexible tubing member comprises a length of helical flexible tubing.

23. A pressurized fluid dispenser for dispensing fluid in respective upright and inverted positions, comprising:

a valve;

a shuttle member having an internal fluid passageway and a fluid inlet for receiving fluid within the container in response to actuation of the valve;

rigid guide means for guiding the shuttle member along a predetermined path under the influence of gravity when the container is moved between the respective upright and inverted positions; and fluid transmission means connected in fluid communication between the valve and the shuttle member.

24. The dispenser of claim 23 wherein the fluid transmission means comprises a flexible conduit adapted to assume a predetermined configuration in each of the respective upright and inverted positions.

25. The dispenser of claim 24 wherein the flexible conduit comprises a length of helical flexible tubing.

26. The dispenser of claim 24 wherein said rigid guide means comprises a rod positioned within the container and said shuttle member comprises mounting means for translatably mounting said shuttle member on the rod.

27. The dispenser of claim 26 wherein the rod has a conduit formed therein and connected in fluid communication between the flexible conduit and the valve.

* * * * *